US006334403B1

(12) United States Patent
Burns

(10) Patent No.: US 6,334,403 B1
(45) Date of Patent: Jan. 1, 2002

(54) PAGE CLAMP WITH INTEGRAL COVER CLIP

(76) Inventor: Michael T. Burns, 9139 Timberglen Dr., Imperial, PA (US) 15126

( * ) Notice: Subject to any disclaimer, the term of this patent is extended or adjusted under 35 U.S.C. 154(b) by 0 days.

(21) Appl. No.: 09/499,224

(22) Filed: Feb. 7, 2000

Related U.S. Application Data

(60) Provisional application No. 60/120,011, filed on Feb. 11, 1999.

(51) Int. Cl.[7] ..... B42D 9/00

(52) U.S. Cl. ..... 116/234; 116/237; 116/239; 24/331; 24/557

(58) Field of Search ..... 116/234, 235, 116/236, 237, 238, 239, 240; D19/32–34; 24/329, 331, 332, 338, 510, 555, 557; 281/30, 42; 206/214, 224, 271

(56) References Cited

U.S. PATENT DOCUMENTS

| | | | | | |
|---|---|---|---|---|---|
| 443,602 | A | * | 12/1890 | Richards | 24/332 |
| 919,806 | A | * | 4/1909 | Bagby | 116/240 |
| 1,415,631 | A | | 5/1922 | Grimm | |
| 1,692,712 | A | * | 11/1928 | Tannebaum | 24/3.5 |
| 1,726,185 | A | * | 8/1929 | Kremski et al. | 24/66.8 |
| D111,781 | S | | 10/1938 | Brennan | |
| 2,321,563 | A | * | 6/1943 | Penley | 24/334 |
| 2,576,783 | A | * | 11/1951 | Dewey | 40/651 |
| 2,664,847 | A | | 1/1954 | Orman | |
| 2,964,010 | A | | 12/1960 | Harrison | |
| 3,090,347 | A | | 5/1963 | Harnett, Jr. | |
| D256,806 | S | | 9/1980 | Tisdale | |
| 4,335,903 | A | | 6/1982 | Collins et al. | |
| 4,487,156 | A | * | 12/1984 | Frost | 16/239 |
| 4,982,685 | A | | 1/1991 | Abe | |
| D350,985 | S | | 9/1994 | Schimke | |
| 5,361,459 | A | * | 11/1994 | Hyvonen et al. | 24/35 |
| 5,577,459 | A | | 11/1996 | Alden | |
| 5,697,594 | A | * | 12/1997 | Adams et al. | 248/442.2 |
| 5,845,889 | A | * | 12/1998 | Suzuki | 248/451 |
| 6,101,689 | A | * | 8/2000 | Jo | 24/338 |
| 6,250,249 | B1 | * | 6/2001 | Yang | 116/234 |

FOREIGN PATENT DOCUMENTS

| | | | | |
|---|---|---|---|---|
| GB | 344050 | * | 12/1929 | 116/237 |
| GB | 422465 | | 1/1935 | |
| GB | 585130 | | 1/1947 | |
| GB | 799211 | | 8/1968 | |

* cited by examiner

*Primary Examiner*—Diego Gutierrez
*Assistant Examiner*—R. A. Smith
(74) *Attorney, Agent, or Firm*—Webb Ziesenheim Logsdon Orkin & Hanson, P.C.

(57) ABSTRACT

A page clamp has a pair of outward facing faces and a pair of opposed faces define by a pair of sides which converge adjacent one end of the clamp. A clip is positioned in spaced relation with one of the outward facing faces. The clip has one end connected to one outward facing face and a second end biased by the clip toward the one outward facing face. The outward facing face can include around the periphery thereof a plurality of tabs defining with the outward facing face a plurality of gaps that can receive an edge of a bookmark therein. A rim can extend normal to the outward facing face and substantially therearound. The bookmark and the outward facing face can also include magnetic material for creating a magnetic attraction therebetween.

13 Claims, 3 Drawing Sheets

PAGE CLAMP WITH INTEGRAL COVER CLIP

CROSS REFERENCE TO RELATED APPLICATION

This application claims priority from U.S. Provisional Patent Application Serial No. 60/120,011, filed Feb. 11, 1999, entitled "Page Clamp with Integral Bookmark Holder".

BACKGROUND OF THE INVENTION

1. FIELD OF THE INVENTION

The present invention relates to page clamps and, more particularly, to page clamps that can be clamped to a cover of a book without extending substantially outside the periphery of the cover.

2. BACKGROUND ART

Page clamps are utilized to secure pages of a book on pages and a cover of a book together in a manner known in the art to facilitate reading of the book. A problem with prior art page clamps is that they cannot readily be clamped to the cover of a closed book when not in use. Moreover, even if clamped to the cover of a closed book, the prior art page clamps typically extend a substantial distance outside the periphery of the cover thus rendering it difficult to store the book with page clamp attached. Because of these problems, page clamps are typically disassociated from the book during storage and have to be found for subsequent use. However, when separated from the book, the prior art page clamps are often lost or not retrieved for subsequent reading of the book.

Moreover, a bookmark is often placed between pages to mark the location in a book where subsequent reading should commence. However, bookmarks are typically disassociated from the book during reading or after the conclusion of reading and have to subsequently be found for subsequent use. However, when separated from the book, bookmarks are often best or not retrieved for subsequent use.

It is, therefore, an object of the present invention to overcome the above problems and others by providing a page clamp that can be attached to a cover of a book substantially within the periphery of the cover. It is an object of the present invention to provide a page clamp which includes an integral bookmark holder. Still other objects of the present invention will become apparent to those of ordinary skill in the art upon reading and understanding the following detailed description.

SUMMARY OF THE INVENTION

Accordingly, I have invented a page clamp having a first blade and a second blade connected in opposition. Each blade has a first end and a second end. A biasing means biases the second ends of the blades toward each other. A clip has a clip body disposed in space relation to a face of the second blade opposite the first blade. The clip body has first end connected to the face of the second blade opposite the first blade. The clip body extends toward and terminates at a second end between the first and second ends of the second blade.

A pivoting means pivotally connects the blades together and the biasing means can bias the pivoting means. The pivoting means can include a pair of arms extending from each blade toward the other blade. The pair of arms of the first blade overlap the pair of arms of the second blade and at least one pivot is projected through the overlapping pair of arms. The biasing means can include a spring biased between an arm of the first blade and an arm of the second blade. The first end of the clip can be connected to the one end of the second blade or between the ends of the second blade.

The face of the first blade opposite the second blade can include a plurality of tabs which define with the face a plurality of gaps. The plurality of gaps can be configured to receive an edge of a bookmark therein when the bookmark is received on the face. The first blade can include a rim which extends between two or more of the tabs and normal to the face.

The bookmark can be formed at least in part of magnetic material. The first blade can include magnetic material for magnetically attracting the bookmark to the first blade. The first blade can include a face on a side thereof opposite the second blade. The face of the first blade can include the magnetic material and the bookmark can be positioned on the face of the first blade and held thereto by magnetic attraction. The magnetic material of the first blade can include one or more magnets and the magnetic material of the bookmark can include one or more magnets.

Preferably, the clip is formed from a material having a spring memory that enables the second end of the clip to more away from the face of the second blade when a cover of a book is inserted therebetween and to return to a position adjacent to or touching the face of the second blade when the cover of the book is extracted from therebetween.

I have also invented an apparatus for securing pages of a book together. The apparatus includes a clamp having a first end, a second end and first and second members positioned in opposition and converging from the first end to the second end. A biasing means biases the first and second members toward each other at the second end of the clamp. The apparatus includes a clip having a first end fixedly connected to a face of the second member opposite the first member and a clip body which extends in spaced relation with the face of the second member toward the one end of the clamp and terminating in a second end between the first end of the clip and the second end of the clamp.

The clip body can include adjacent a second end thereof a laterally extending tab which extends beyond a periphery of the second member. The first member can include magnetic material that attracts a bookmark that includes magnetic material.

Lastly, I have invented a page clamp for securing the pages of a book. The page clamp includes a clamp having a pair of outward facing faces and a pair of opposed faces defined by a pair of sides which converges adjacent one end of the clamp. A clip is positioned in spaced relation with one of the outward facing faces. The clip has one end connected to the one outward facing face and a second end bias by the clip toward the one outward facing face.

DETAILED DESCRIPTION OF THE PREFERRED EMBODIMENTS

Figure 1A:
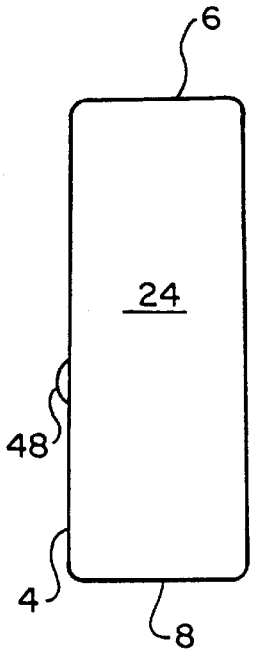
FIGS. 1*a*–1*d* are front elevational, side elevational, back elevational and top views of a page clamp in accordance with the present invention.
Figure 1B:
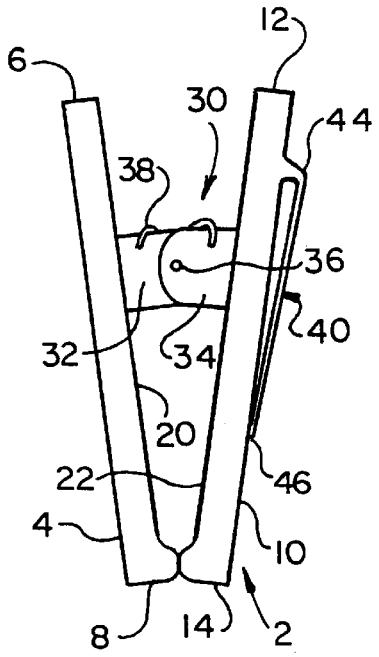
Figure 1C:
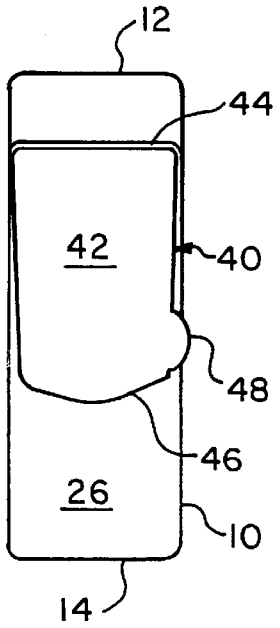
Figure 1D:
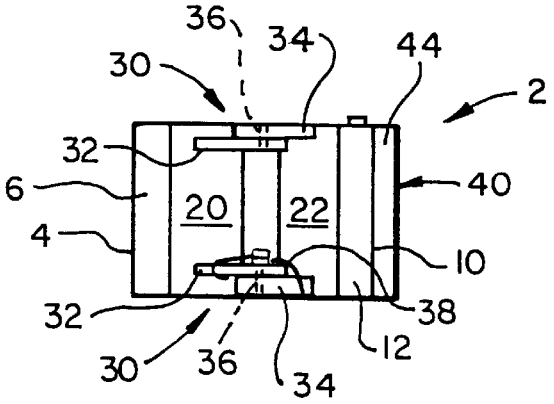

With reference to FIGS. 1*a*–1*d*, a page clamp 2 includes a first member or blade 4 having a first end 6 and a second end 8, and a second member or blade 10 having a first end 12 and a second end 14. First and second members 4 and 10 include faces 20 and 22 positioned in opposition and external faces 24 and 26 which face away from each other.

A pivoting means 30 pivotally connects first member 4 and second member 10. Preferably, pivoting means 30 includes a pair of spaced arms 32 which extend normal to face 20 of first member 4 and a pair of spaced arms 34 which extend normal to face 22 of second member 10 and overlap spaced arms 32. The ends of arms 32 and 34 opposite face 20 and 22, respectively, are pivotally connected together by one or more pivots 36 which are projected through overlapping arms 32 and 34.

A biasing means or spring 38 is biased between one arm 32 of first member 4 and one arm 34 of second member 10. Pivoting means 30 and pivot 36 coact so that first member 4 and second member 10 converge toward each other from the first ends 6 and 12 thereof to the second ends 8 and 14 thereof. Biasing means 38 contacts with the pivoting means 30 to coact to bias the second ends 8 and 14 of first member 4 and second member 10 toward each other.

Figure 2A:
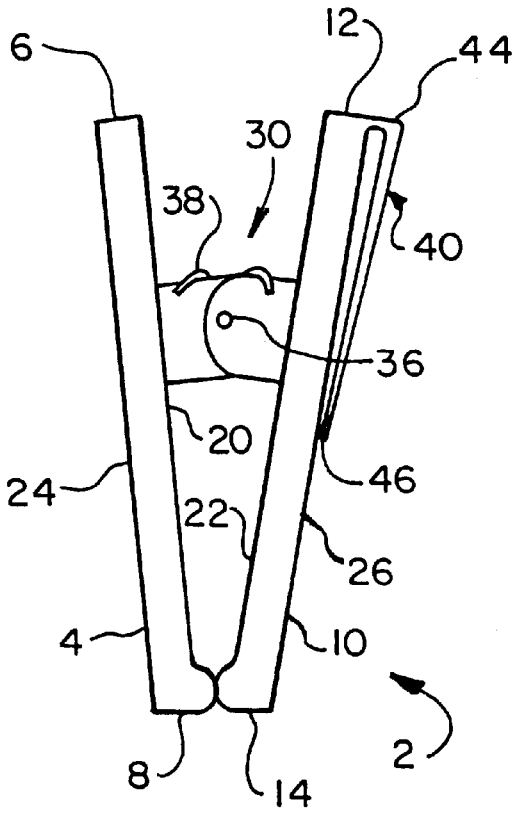
FIGS. 2*a* and 2*b* are side elevational and back elevational views of a page clamp in accordance with another embodiment of the present invention.
Figure 2B:
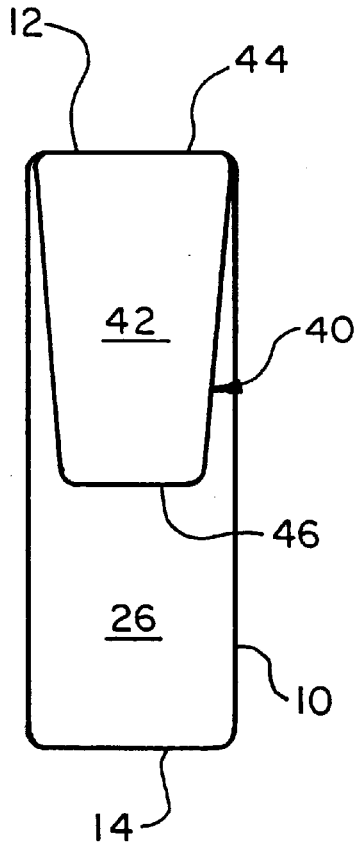

A clip 40 has a clip body 42 disposed in spaced relation with external face 26 of second member 10. The clip body 42 has a first end 44 connected to external face 26. The clip body 42 extends toward second end 14 of second member 10 and terminates in a second end 46 between the first end 44 of clip 40 and the second end 14 of second member 10. In the embodiment shown in FIGS. 1*a*–1*d*, the first end 44 of clip 40 is connected between first end 12 and second end 14 of second member 10. However, as shown in FIGS. 2*a* and 2*b*, first end 44 of clip 40 can be connected to first end 12 of second member 10.

With continuing reference to FIGS. 1*a*–1*d*, clip 40 can include adjacent second end 46 thereof a tab 48 which extends laterally from the periphery of clip body 42 and which extends beyond a side of second member 10. Tab 48 facilitates application of a force for separating second end 46 of clip 40 from external face 26 of second member 10.

Clip 40 is formed from a material having a spring memory that biases second end 46 to a position adjacent or touching external face 26 of second member 10. This spring memory enables second end 46 of clip 40 to move away from external face 26 of second member 10 when a cover of a book is inserted therebetween. Moreover, this spring memory enables the second end 46 of clip 40 to return to the position adjacent to or touching the external face 26 of second member 10 when the cover of the book is extracted from therebetween.

Figure 3A:
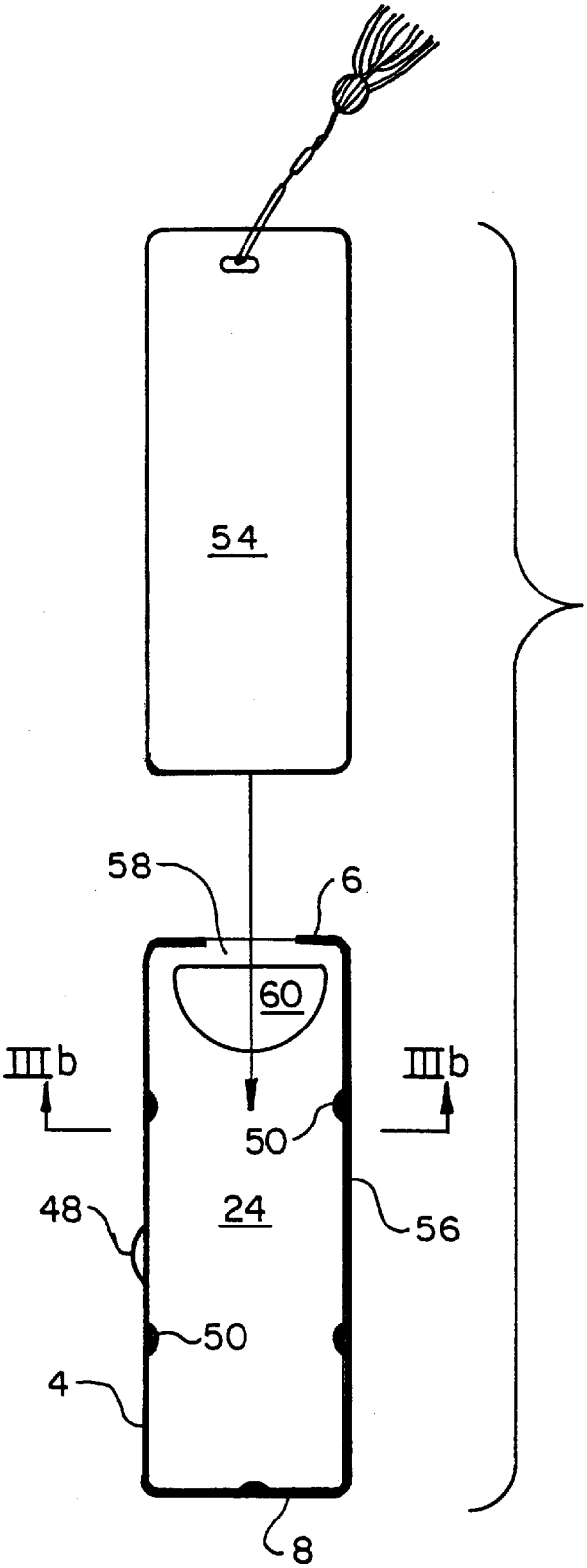
FIG. 3*a* is a front elevational view of a page clamp including tabs and a rim for receiving a bookmark.
Figure 3B:
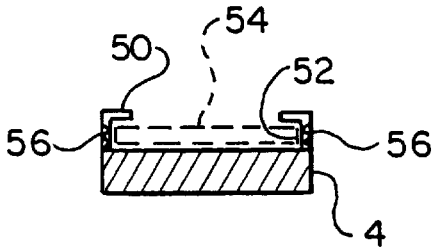
FIG. 3*b* is a sectional view taken along line IIIb—IIIb in FIG. 3*a*.

With reference to FIGS. 3*a* and 3*b*, and with ongoing reference to FIGS. 1*a*–2*b*, preferably first member 4 includes a plurality of L-shaped tabs 50 which define with external face 24 of first member 4 a plurality of gaps 52 that are configured to receive an edge of a bookmark 54 therein. When bookmark 54 is received on external face 24 of first member 4, the plurality of tabs 50 are positioned and oriented on first member 4 to receive the edge of bookmark 54 in the plurality of gaps 52 thereby retaining bookmark 54 adjacent external face 24 of first member 4. In the embodiment shown in FIG. 3*a*, the plurality of tabs 50 are disposed around a periphery of external face 24 of first member 4. A rim 56 can extend normal to external face 24 of first member 4 substantially around the periphery thereof to receive the edge of bookmark 54 therein. Rim 56 can include a gap 58, preferably adjacent first end 6 of first member 4 to facilitate sliding insertion and/or sliding removal of the edge of bookmark 54 into and out of gaps 52 and the boundary formed by rim 56.

Bookmark 54 can be formed from or can include magnetic material and first member 4 can be formed from or can include magnetic material which attracts the magnetic material of bookmark 54 to secure bookmark 54 to external face 24 of first member 4. For example, bookmark 54 can be formed at least in part of magnetically susceptible material and first member 4 can be formed from or can include magnetic material, such as one or more permanent magnets, for a magnetically attracting bookmark 54 to first member 4. In another example, bookmark 54 can be formed at least in part from magnetic material and first member 4 can include magnetically susceptible material which is magnetically attracted to the magnetic material of the bookmark 54. In this embodiment, external face 24 of first member 4 can include the magnetically susceptible material and bookmark 54 can include one or more magnets affixed thereto. The magnetic material can be utilized with the first member 4 and the bookmark 54, either alone or in combination, with the tabs 50 and/or the rim 56.

In use, a compressive force can be applied to first ends 6 and 12 of first member 4 and second member 10 to cause second ends 8 and 14 to more apart against the bias of biasing means 38 for receiving the pages and/or cover of a book therebetween. Thereafter, the compressive force can be released to enable the biasing means 38 to bias the second ends 8 and 14 together thereby clamping the pages and/or cover of the book.

Upon completion of reading, bookmark 54 is separated from external face 24 of first member 4 and inserted at a desired location in the book. Thereafter, the pages and/or cover of the book are removed from between second ends 8 and 14. Next, the cover of the book is slid between second end 46 of clip 40 and external face 26 of second member 10 toward first end 44 of clip 40 thereby securing page clamp 2 to the cover of the book. Since first end 44 of clip 40 connected on or adjacent first end of second member 10, clamp 2 substantially withers?? the periphery of the cover of the book. When it is desired to read the book again, the cover is extracted from between second end 46 of clip 40 and external face 26 of second member 10. Thereafter, the pages and/or cover of the book is clamped between the second ends 8 and 14 of first and second members 4 and 10 in the manner described above. Next, bookmark 54 is secured to the external face 24 of first member 24 by magnetic attraction and/or by sliding the edge of bookmark 54 into the gaps 52 formed between the tabs 58 and the external face of first member 24.

The invention has been described with reference to the preferred embodiments. Obvious modifications and alterations will occur to others upon reading and understanding the preceding detailed description. For example, external face 24 can include an artistic design or an artistic form, e.g., a molded figure, in place of the attached bookmark. Moreover, first member 4 can include an aperture 60 therethrough adjacent first end 6 to facilitate removal of bookmark 54 out of gaps 52 and the boundary formed by rim 56. It is intended that the invention be construed as including all such modifications and alterations insofar as they come within the scope of appended claims or the equivalents thereof.

I claim:

1. A page clamp comprising:

a first blade and a second blade connected in opposition, each said blade having a first end and a second end;

biasing means for biasing the second ends of the blades toward each other; and a clip having a clip body disposed in spaced relation to a face of the second blade opposite the first blade, the clip body having a first end connected to the face of the second blade opposite the first blade, the clip body extending toward and terminating at a second end between the first and second ends of the second blade, wherein:

the face of the first blade opposite the second blade includes a plurality of tabs which define with the face a plurality of gaps, the plurality of gaps configured to receive an edge of a bookmark therein when the bookmark is slidingly received on the face; and a rim which extends between at least two of said tabs and normal to the face.

2. The page clamp as set forth in claim 1, further including pivoting means for pivotally connecting the blades together.

3. The page clamp as set forth in claim 2, wherein the biasing means biases the pivoting means.

4. The page clamp as set forth in claim 1, further including:

a pair of arms extending from each blade toward the other blade, with the pair of arms of the first blade and the pair of arms of the second blade overlapping; and at least one pivot extending through the overlapping pairs of arms.

5. The page clamp as set forth in claim 4, wherein the biasing means includes a spring biased between one said arm of the first blade and one said arm of the second blade.

6. The page clamp as set forth in claim 1, wherein the first end of the clip is connected to one of (i) one of the ends of the second blade and (ii) between the ends of the second blade.

7. The page clamp as set forth in claim 1, wherein the clip is formed from a material having a spring memory that enables the second end of the clip to move away from the face of the second blade when a cover of a book is inserted therebetween and to return to the position adjacent to or touching the face of the second blade when the cover of the book is extracted from therebetween.

8. A page clamp comprising:

a first blade and a second blade connected in opposition, each said blade having a first end and a second end;

biasing means for biasing the second ends of the blades toward each other;

a clip having a clip body disposed in spaced relation to a face of the second blade opposite the first blade, the clip body having a first end connected to the face of the second blade opposite the first blade, the clip body extending toward and terminating at a second end between the first and second ends of the second blade; and a bookmark formed at least in part of magnetic material wherein, the first blade includes magnetic material for magnetically attracting the bookmark to the first blade.

9. The page clamp as set forth in claim 8, wherein:

the first blade includes a face on a side thereof opposite the second blade;

the face of the first blade includes the magnetic material; and the bookmark can be positioned on the face of the first blade and held thereto by magnetic attraction.

10. The page clamp as set forth in claim 8, wherein the magnetic material of the first blade includes one or more magnets.

11. The page clamp as set forth in claim 8, wherein the magnetic material of the bookmark includes one or more magnets.

12. An apparatus for securing pages of a book together, the apparatus comprising:

a clamp having a first end, a second end, a second end and first and second members positioned in opposition and converging from the first end to the second end;

biasing means for biasing the first and second members toward each other at the second end of the clamp; and a clip having a first end fixedly connected to a face of the second member opposite the first member and a clip body which extends in spaced relation with the face of the second member toward one said end of the clamp and terminating in a second end between the first end of the clip and the second end of the clamp, wherein the clip body includes adjacent the second end thereof a laterally extending tab which extends beyond a periphery of the second member.

13. The apparatus as set forth in claim 12, wherein the first member includes magnetic material that attracts a bookmark that includes magnetic material.

* * * * *